US009327421B2

(12) United States Patent
Béguin

(10) Patent No.: US 9,327,421 B2
(45) Date of Patent: May 3, 2016

(54) DEVICE FOR A UNIT FOR EJECTING WASTE IN A MACHINE FOR PRODUCING PACKAGING

(75) Inventor: Boris Béguin, Féchy (CH)

(73) Assignee: BOBST MEX SA (CH)

( * ) Notice: Subject to any disclaimer, the term of this patent is extended or adjusted under 35 U.S.C. 154(b) by 420 days.

(21) Appl. No.: 13/885,835

(22) PCT Filed: Nov. 3, 2011

(86) PCT No.: PCT/EP2011/005534

§ 371 (c)(1),
(2), (4) Date: May 16, 2013

(87) PCT Pub. No.: WO2012/065690

PCT Pub. Date: May 24, 2012

(65) Prior Publication Data

US 2013/0228056 A1 Sep. 5, 2013

(30) Foreign Application Priority Data

Nov. 19, 2010 (EP) ..... 10014767

(51) Int. Cl.
*B26D 7/18* (2006.01)
*B26F 1/40* (2006.01)

(52) U.S. Cl.
CPC ..... *B26D 7/18* (2013.01); *B26D 7/1818* (2013.01); *B26F 1/40* (2013.01); *B26D 2007/1881* (2013.01); *Y10T 83/2074* (2015.04)

(58) Field of Classification Search
CPC ..... Y10T 225/221; Y10T 83/2074; Y10T 83/2079; Y10T 83/0467; Y10T 83/9374; Y10T 83/9377; Y10T 83/9379; Y10T 83/2077; Y10T 83/21; B26D 7/18; B26D 7/1818; B26D 2007/1818; B26F 1/40
USPC ..... 225/3, 99, 98, 97, 96
See application file for complete search history.

(56) References Cited

U.S. PATENT DOCUMENTS 3,266,388 A * 8/1966 Jones ..... B26D 7/1818 225/97
3,371,584 A * 3/1968 Zernov ..... B26D 7/1836 225/97

(Continued)

FOREIGN PATENT DOCUMENTS

CH WO 2010130436 A1 * 11/2010 ..... B26D 7/1836
WO WO 2010/130436 A1 11/2010

OTHER PUBLICATIONS

International Search Report dated Dec. 21, 2011 issued in corresponding International patent application No. PCT/EP2011/005534.

*Primary Examiner* — Sean Michalski
*Assistant Examiner* — Jonathan Riley
(74) *Attorney, Agent, or Firm* — Ostrolenk Faber LLP

(57) ABSTRACT

A device for a waste stripping unit fitted with two rotating tools which cooperate to strip at least one item of waste which originates from a blank of a plate element (4) which passes through the unit and between the two tools. At least one tool has pins that remove the waste items. At least one part (39) is inserted between the two tools and which forms a support for the blank and also opens a passage for the stripped off waste. The part is shaped and positioned in accordance with the layout of the blank.

7 Claims, 1 Drawing Sheet

(56) References Cited

U.S. PATENT DOCUMENTS

| | | | | | |
|---|---|---|---|---|---|
| 3,435,737 | A | | 4/1969 | Sarka | |
| 3,524,364 | A | * | 8/1970 | Bishop | B26D 7/1818 493/342 |
| 3,643,553 | A | | 2/1972 | Morimoto | |
| 3,956,974 | A | * | 5/1976 | Schroter | B26D 7/1818 493/342 |
| 4,467,948 | A | * | 8/1984 | Deslauriers | B26D 7/1827 225/97 |
| 4,985,012 | A | * | 1/1991 | Marschke | B26D 7/1818 493/373 |
| 5,049,122 | A | * | 9/1991 | Marschke | B26D 7/1818 493/373 |
| 5,058,472 | A | * | 10/1991 | Kakko-Chiloff | B23D 35/008 83/344 |
| 5,271,541 | A | * | 12/1993 | Roux | B65H 20/12 226/95 |
| 5,676,362 | A | * | 10/1997 | Ferraris | B41F 21/00 271/197 |
| 2004/0053761 | A1 | | 3/2004 | Georgiades | |

* cited by examiner

DEVICE FOR A UNIT FOR EJECTING WASTE IN A MACHINE FOR PRODUCING PACKAGING

CROSS-REFERENCE TO RELATED APPLICATIONS

The present application is a 35 U.S.C. §§371 national phase conversion of PCT/EP2011/005534, filed Nov. 3, 2011, which claims priority of European Patent Application No. 10014767.7, filed Nov. 19, 2010, the contents of which are incorporated by reference herein. The PCT International Application was published in the French language.

BACKGROUND OF THE INVENTION

The present invention relates to a device which is intended for a waste stripping unit. The invention also relates to a waste stripping cassette which is intended for a waste stripping unit which is provided with a device. The invention relates to a waste stripping unit which comprises a waste stripping cassette. The invention relates to a waste stripping unit which comprises a device. The invention relates to a packaging production machine which successively comprises a cutting unit and a waste stripping unit.

A packaging production machine is intended for the production of boxes, which form packagings, after folding and gluing. In this machine, an initial plane support, such as a continuous cardboard web, is unwound and is printed by a printing unit which is itself constituted by sub-units in the form of printing groups. The web is then transferred to a cutting unit. The cutting operation allows plate elements to be produced, in this instance blanks which are constituted by a plurality of boxes which are joined together.

The blanks obtained have waste zones which form cardboard discards which are removed by means of ejection. These zones are separated from the rest of the blank by operation of a waste stripping unit. The blanks are then conveyed to a separator in order to be separated from each other, in order to obtain individual boxes.

The waste stripping unit is mounted following the cutting unit. The stripping unit ensures precise and rapid stripping of the waste. The operation precision of the ejection unit also prevents the waste and the blank from bringing about jams.

The stripping unit comprises two tools, in the form of two rotary cylinders, which are most often positioned parallel with each other, and one above the other, so as to cooperate with each other. The blanks run between the two cylinders following a substantially horizontal path.

PRIOR ART

Documents US-2004/0,053,761 and U.S. Pat. No. 3,643,553 give examples of stripping systems for cut waste.

One of the cylinders, the lower cylinder, comprises radial needles which are pressed into each waste zone. The needles separate the waste from the blank by carrying the waste zones with the rotation of this lower needle cylinder. The needles are positioned on the one cylinder in accordance with a layout. The waste is then disengaged from these radial needles during the rotation of the cylinders. To this end, ejectors in the form of fixed combs are arranged parallel with the cylinders. The radial needles are thus released from the waste and become pressed into other waste of the following blank during the next revolution of the cylinder.

The other of the cylinders, the upper cylinder, may have at the surface thereof a flexible coating of the vulcanized rubber type. Holes are made at various locations in the other cylinder or in the rubber coating, depending on the version. The position of the holes corresponds to the layout and therefore to that of the needles of the one or lower cylinder. The needles are received in the holes during the rotation of the two cylinders, in order to readily perforate the waste. The upper and lower cylinders ensure the transport and maintain of the blanks during the perforation of the waste.

Document U.S. Pat. No. 3,435,737 describes a method and device for stripping waste from a sheet. A stripping needle which is carried by a lower stripping cylinder is introduced into the waste and removes it from the sheet. The waste is then removed from the stripping needle. The sheet passes into a pinching zone between the lower cylinder and the upper cylinder, the sheet being supported by an assembly of spaced-apart support fingers or bars. The needle extends between the support fingers. The waste which has to be separated from the sheet can pass between the fingers which are mutually spaced apart.

However, the waste is attached to the boxes and to the blanks by means of nicks. The nicks connect two edges of a cutting line between a waste and a box and constitute bridges of the same material as the waste, the boxes and the blanks. In this manner, in such stripping systems, if the nicks are not broken, the needles which are nailed in the waste also carry the blanks and the boxes during the rotation of the needle cylinder. This waste which is poorly separated from the blanks and the boxes leads to jam of the waste stripping unit, and to stoppage of the entire packaging production machine.

Waste surrounds zones of the box which are more fragile, such as glue tabs or lugs or folded flaps. The perforation of this waste thus causes the tabs and the flaps to be carried with the waste itself. The tabs and the flaps become torn and/or folded in an untimely manner, in particular in the case of cardboard having a low basis weight. Jams are generated further downstream in the machine if the adhesive gluing tabs are folded down.

STATEMENT OF INVENTION

A main objective of the present invention involves developing a device for a waste stripping unit. A second objective is to provide a device which facilitates the separation between waste and the cut plate elements. A third objective is to facilitate the transfer of blanks of plate elements through the waste stripping unit. A fourth objective is to optimize the precision of the stripping of the waste. A fifth objective is to prevent the phenomena of jam in a waste stripping unit and to limit the machine downtime. A sixth objective is to prevent the disadvantages of the units and the arrangements of the prior art. Another objective is to provide a packaging production machine with a waste stripping unit which is integrated after an upstream cutting unit and which has a high degree of flexibility of use.

According to an aspect of the present invention, a device is provided for a waste stripping unit fitted with two rotating tools which are arranged so as to cooperate with each other and to strip at least one item of waste. The waste originates from a blank of a plate element. The blank of the plate element passes through the waste stripping unit, passing between the two rotating tools. The device comprises at least one part, which is capable of being inserted between the two rotating tools. The part or parts form a support for the blank of the plate element and a passage for the stripping of the item of waste.

The device is characterized in that the part or parts are shaped and positioned in accordance with the layout of the blank of the plate element.

That is to say, the blank of the plate element is sandwiched with the device and the two tools. The device acts as a bridge between an inlet and an outlet of the stripping unit. The device stabilizes the blank during the stripping of the waste. The blank remains towed by the two tools which are mutually synchronized. When the waste is stripped, the blank is advanced and maintained between the two rotating tools. The waste is stripped and the blank keeps an optimum trajectory between the inlet and the outlet.

The systems of the prior art release the blank through the stripping. The device with the constituent part or parts thereof according to the invention is provided in accordance with the layout, i.e. the template, design or marking of the blank.

The device provides a constant support for the blank. With the shape and the arrangement thereof, the device ensures the stability of the transfer of the blank, whilst permanently providing a support plane for the zones of the blank which have no waste. With the shape and the arrangement thereof, the device prevents the same zones with no waste from following the waste at the time of their removal. With such a device, the stripping is facilitated and promotes the production of plate elements having more complex cut shapes, with numerous waste zones and numerous zones outside the waste and around the waste.

Owing to the direct passage of the blank through the stripping owing to the device, there are no other elements to be adjusted in the immediate vicinity of the tools with a very high degree of precision, in order to ensure the transfer and prevent any risk of jam. The device is simply placed at the unit, without requiring adjustments.

The upstream and downstream directions are defined with reference to the movement direction of the plate elements, in the longitudinal direction in the waste stripping unit and in the whole of the packaging production machine. The longitudinal direction is defined with reference to the movement direction of the plate elements in the waste stripping unit and in the machine, in accordance with the longitudinal center axis thereof. The transverse direction is defined as being the direction perpendicular relative to the movement direction of the plate elements. The front and rear positions are defined relative to the transverse direction as being the operator's side or side of the driver, respectively, and the opposite operator's side or opposite side of the driver, respectively.

In another aspect of the invention, a waste stripping cassette, which is for a waste stripping unit and which is positioned downstream of a cutting unit for cutting a plane support into plate elements, comprises a frame which is provided with bearings, carrying two rotating tools which cooperate with each other, is capable of being introduced, attached and removed from the waste stripping unit, and is characterized in that it comprises a device which has one or more of the technical features described below and claimed.

In another aspect of the invention, a waste stripping unit for use in a packaging production machine which is positioned downstream of a cutting unit for cutting a plane support into plate elements, comprises a frame and two rotating tools which cooperate with each other, is characterized in that it comprises a stripping cassette which has one or more of the technical features described below and claimed.

In another aspect of the invention, a waste stripping unit in a packaging production machine, which is positioned downstream of a cutting unit for cutting a plane support into plate elements, comprising a frame and two rotating tools which cooperate with each other, is characterized in that it comprises a device which has one or more of the technical features described below and claimed.

According to yet another aspect of the invention, a packaging production machine, is characterized in that it comprises the unit which has one or more of the technical features described below and claimed and which is positioned downstream of a cutting unit.

BRIEF DESCRIPTION OF THE DRAWINGS

The invention will be readily understood and the various advantages and different features will be better appreciated from the following description of the non-limiting embodiment, with reference to the appended schematic drawings, in which.

DETAILED DESCRIPTION OF PREFERRED EMBODIMENTS

Figure 1:
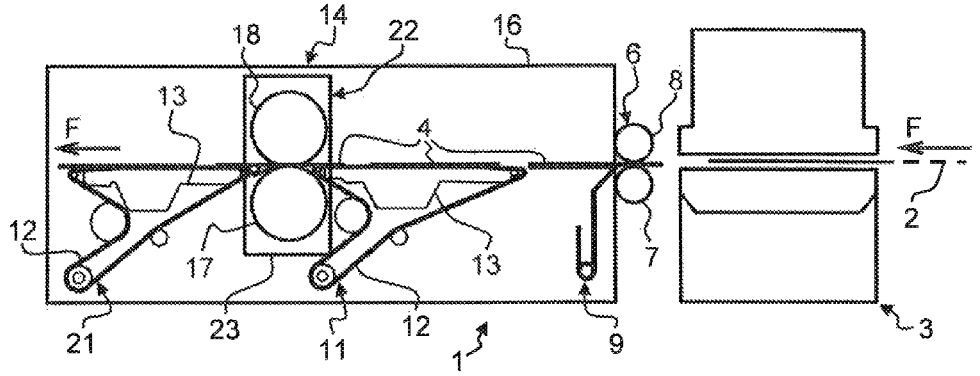
FIG. 1 is a synoptic side view of a packaging production machine with a waste stripping unit.

As illustrated in FIG. 1, a packaging production machine 1 processes a support or a material in the form of a continuous web 2, which in this instance is flat cardboard. The machine 1 comprises a conversion unit, for example a cutting press with platen 3. Upstream of the press 3, the machine 1 may have units such as printing groups, means for checking the quality and the register, embossing groups, etc. (not illustrated).

The web 2 enters into the press 3 in the horizontal state via the upstream transverse side thereof. The press 3 cuts the web 2 and releases the support in the form of plate element blanks, i.e. blanks 4 of flat cardboard. The blanks 4 are going out from the press 3 via the downstream transverse side thereof. The advance or running direction (arrows F) of the web 2 and blanks 4 in the longitudinal direction indicates the upstream direction and the downstream direction.

The machine 1 comprises a drive arrangement 6, which is arranged downstream of the press 3. This arrangement 6 first comprises a lower drive roller 7 which is rotatably driven by a motor. The arrangement 6 then comprises a single or a series of pressing rollers 8 which are arranged above in abutment against the roller 7. The blanks 4 are engaged, maintained and driven between the roller 7 and the roller or rollers 8. The arrangement 6 ensures active transfer of the blanks 4, so as to release the blanks 4, successively one after the other, from the press 3, in the longitudinal direction F along the downstream direction.

The machine 1 comprises a transfer device 9 for the blanks 4. The device 9 is intended to transfer the blanks 4 to the downstream direction successively one after the other, starting from the arrangement 6, along the longitudinal direction F.

The machine 1 then comprises a first transport assembly which is more specifically a first vacuum transport 11 and which is arranged downstream of the transfer device 9. This first vacuum transport 11 comprises a conveyor with one or more endless belts 12 with holes. A vacuum casing 13, which is connected to a vacuum source, presses the blanks 4 against the belt 12.

The blanks 4 are disposed on the upper face of the belt 12, one after the other, with a short gap between them. The first vacuum transport 11 ensures active transfer of the blanks 4. The belt 12 carries the blanks 4 along the longitudinal direction F, from the upstream to the downstream direction.

The machine 1 then comprises a waste stripping unit 14, which is placed downstream of the press 3 and after the first vacuum transport 11. This unit 14 allows the cardboard waste which is precut from the blanks 4 to be removed in a controlled manner.

The waste stripping unit 14 comprises a carrier structure or frame 16. The operational portion of the unit 14 comprises a first cylindrical lower rotating tool 17 which cooperates with a second cylindrical upper rotating tool 18. The two tools 17 and 18 are mounted, parallel with each other, one above the other, and transversely relative to the frame 16 and thus the unit 14. The blanks 4 pass through the unit 14, passing between the two tools 17 and 18.

The lower tool 17 is provided with radial needles (not visible) which protrude radially in the direction of the upper tool 18. These needles are positioned in an appropriate manner on the surface of the lower tool 17 at the locations where the cutting of the web 2 produces waste. In this manner, these needles penetrate into each of the waste. The waste is torn from the blanks and carried by the rotation of the lower tool 17, and is removed using combs which are mounted close to the lower tool 17.

The upper tool 18 may be a cylinder which is coated with a layer of flexible vulcanized rubber (not visible). Holes 19 may be provided in the upper tool 18 in the rubber layer. The end of each of the needles of the lower tool 17 is received in a hole 19 of the upper tool 18.

The machine 1 comprises a second transport assembly which is more specifically a second vacuum transport 21, and which is arranged downstream of the waste stripping unit 14. The second transport assembly 21 is substantially similar to the first transport assembly 11, with endless belts 12 having holes and a vacuum casing 13.

The transfer device 9, the first vacuum transport 11 and the second vacuum transport 21 are mounted in the frame 16. The removal of the waste outside the waste stripping unit 14 is carried out by means of suction.

The machine 1 then comprises a separator (not illustrated) which is arranged downstream of the waste stripping unit 14, after the second transport assembly 21. The nicks present on the blanks 4 and between the boxes are broken owing to the separator and the blanks 4 are thus converted into boxes.

In a particularly favorable embodiment (see FIGS. 1 and 2), the waste stripping unit 14 may comprise a removable cassette 22. The removable cassette 22 is capable of being introduced into the frame 16, of being attached to the frame 16 and, conversely, of being disjoined and removed from this frame 16.

Figure 2:
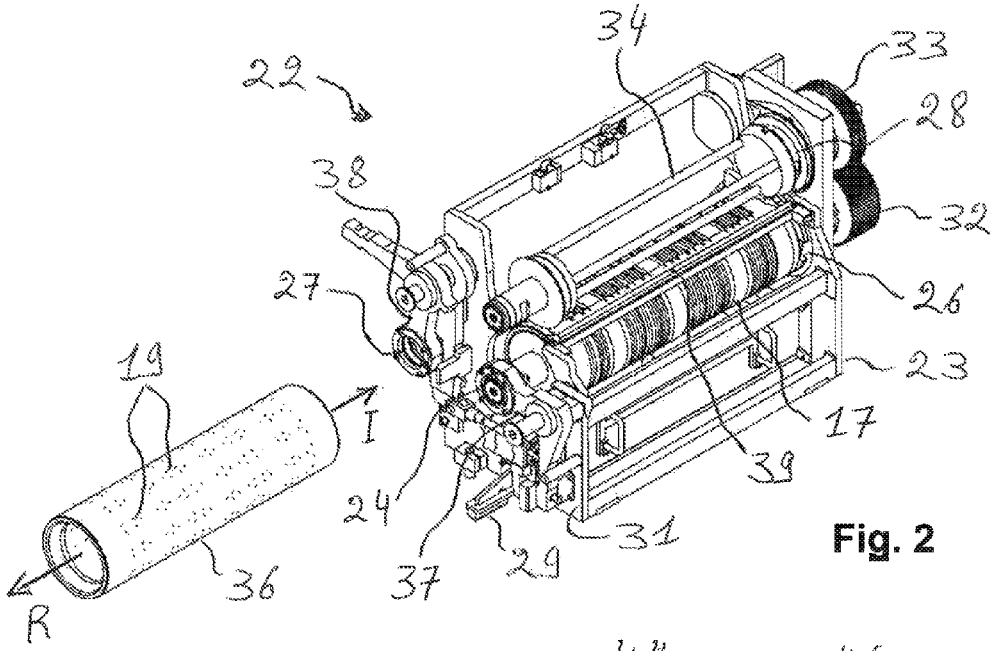
FIG. 2 is a perspective view of a waste stripping cassette, with a sleeve of one of the two tools in a withdrawn position, comprising a device according to the invention.
Figure 3:
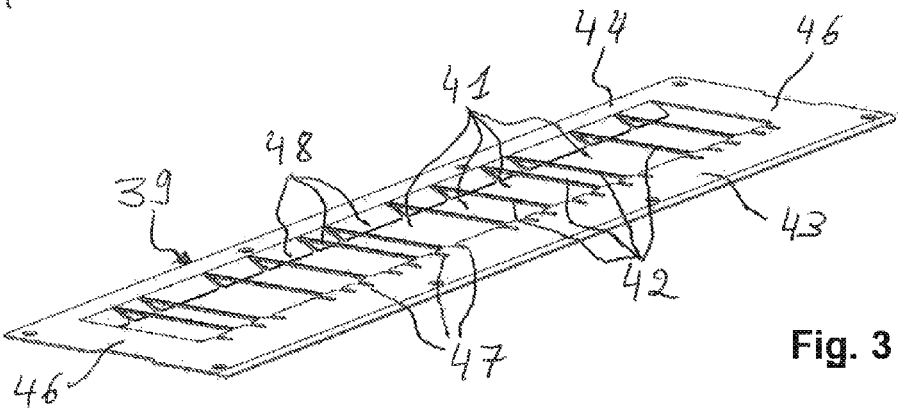
FIG. 3 is a perspective view of the device which can be seen in FIG. 2.

The removable cassette 22 comprises a carrier structure or frame 23. As can be seen in FIG. 2, the frame 23 is provided with a lower front bearing 24 and a lower rear bearing 26 which carries the first tool, i.e. the lower tool 17. The frame 23 is provided with an upper front bearing 27 and an upper rear bearing 28 which carries the second tool, i.e. the upper tool 18.

The unit 14 comprises a transverse housing which is arranged in the frame 16 between the first transport assembly 11 and the second transport assembly 21. The cassette 22 may be introduced into this transverse housing transversely relative to the frame 16. Conversely, the cassette 22 may be removed from this transverse housing transversely relative to the frame 16.

The cassette 22 comprises transverse movement means, which also serve to adjust the transverse position thereof in the unit 14. These means are in the form of a rack 29 which protrudes at the front face 31 of the frame 23. The rack 29 is capable of cooperating with a pinion which is driven by an electric motor which is present at the frame 16. Means for locking the longitudinal position of the cassette 22 relative to the frame 16 are provided.

The cassette 22 comprises drive means which are intended to rotatably drive the two tools 17 and 18. These means are in the form of a first pinion 32 for the first tool 17. This first pinion 32 meshes with a second pinion 33 for the second tool 18. The introduction of the cassette 22 into the frame 16 causes the teeth of the first pinion 32 to engage with those of a cooperating pinion of a motor of the unit 14.

The two tools 17 and 18 are formed with a mandrel 34 and a removable cylindrical sleeve 36. Only the second tool 18 has been illustrated in FIG. 2. The sleeve 36 is inserted (arrow I), is locked and is driven in rotation by the mandrel 34 of the tool 18. The sleeve 36 is unlocked and is then withdrawn (arrow R). The sleeve of the lower tool 17 is a hollow cylinder with a wall in which the waste stripping needles which protrude radially and outwards are engaged. The sleeve 36 of the upper tool 18 is a hollow cylinder with a wall in which the series of holes 19 is provided.

In order to allow the insertion I or the removal R and to change the sleeve 36 during a job change of job and tools 17 and 18, the lower front bearing 24 of the lower tool 17 is inserted into a lower arm 37 which can be moved by means of transverse sliding, then pivoting in a longitudinal plane. The upper front bearing 27 of the upper tool 18 is inserted into an upper arm 38 which can be moved by means of transverse sliding, then pivoting in a longitudinal plane.

In order to facilitate the stripping of the waste and in accordance with the invention, the stripping unit 14 and/or the cassette 22 comprise a device for stabilizing the blanks 4. The device comprises at least one bridge-like part 39 between the first vacuum transport 11 and the second vacuum transport 21. The part 39 forms a support for the blanks 4 during the stripping of the waste. Owing to the part 39, the blanks 4 are not carried downwards by the lower tool 17 which pierces the waste with the needles thereof. The blanks 4 which are carried in a downstream direction by the first vacuum transport 11 then pass over the part 39 and are carried by the second vacuum transport 21.

The part 39 is capable of being inserted between the two tools 17 and 18. The part 39 preferably extends through all or part of a space located between the two tools 17 and 18 between an upstream inlet and a downstream outlet of the unit 14, and more particularly between an upstream inlet and a downstream outlet of the cassette 22. The part 39 is mounted substantially tangentially relative to the two tools 17 and 18. The part 39 is sized so as to be accommodated substantially in the horizontal in a radial gap located between the two tools 17 and 18. The part 39, which is fixed, and the blanks 4, which are moving, pass via this gap.

The part 39 advantageously has an upper plane which extends just below the outer surface of the first lower rotating tool 17. The fact that the part 39 is located below the surface of the lower tool 17 does not interfere with the advance of the web 4 which will be carried out by the vacuum transports 11 and 21. The speed of the two stripping cylinders 17 and 18 is synchronized with the speed of the two vacuum transports 11 and 21.

The part 39 is shaped so as to form a passage for the waste which is stripped by the first tool 17. In a favorably manner, the part 39 is a plate. One or more openings 41 to allow the waste to pass are provided in the plate. The number, shape, dimensions and position of the openings 41 are dependent on the number, shape, dimensions and position of the waste. The number, shape, dimensions and position of the openings 41 are dependent on the layout provided for the plate element, and therefore the complexity and the solidity of the cut blank 4. A plurality of waste may pass through a single opening 41.

The openings 41 have flat edges, being delimited by longitudinal rods 42. The rods 42 form the support for the blanks 4. The openings 41 are also delimited by an upstream transverse metal sheet 43, a downstream transverse metal sheet 44 and two lateral longitudinal metal sheets 46. The openings 41 and thus the rods 42 have shapes and widths which vary in accordance with the layout resulting in the blank 4, between the upstream transverse metal sheet 43 and the downstream transverse metal sheet 44.

The part 39 is attached to the frame 23 of the cassette 22, at the inlet by the upstream metal sheet 43 and at the outlet by the downstream metal sheet 44. For reasons of efficiency of maintaining the blanks 4, the part 39 is positioned as close as possible to the first tool 17.

However, collisions between the needles which protrude radially outwards from the outer surface of the first tool 17 and the part 39 must be avoided. To this end, the part 39 preferably comprises at least one longitudinal recess or notch 47.

This notch or these notches 47 are located at the inlet of the unit 14 and/or the cassette 22. The notches 47 are cut longitudinally in the upstream metal sheet 43 and open out in the downstream direction in the passage for the waste, i.e. in the openings 41. The notches 47 are sized in order to allow at least one stripping needle to pass through.

When the waste is pierced by the first tool 17, the glue tabs and/or flaps of the blanks 4, which are more flexible and more fragile zones, have a tendency to follow the same path as that of the waste which surrounds them. The flaps and the tabs are folded by following the rotation of the first tool 17. In order to prevent jams, the part 39 advantageously comprises at least one longitudinal slant 48.

This slant or these slants 48 are located at the outlet of the unit 14 and/or the cassette 22. The slants 48 originate from longitudinal notches in the downstream metal sheet 44 in the extension of the openings 41 and on either side of the rods 42. The slants 48 leave the tangential plane between the two tools 17 and 18. The slants 48 are folded downwards and are orientated in the direction of the first tool 17. A free edge of each slant 48 is located in the passage for the waste, i.e. in the openings 41. The slants 48 are sized to catch the flaps and the tabs and to return them to the transport plane of the web 4.

The present invention is not limited to the embodiments described and illustrated. Numerous modifications can be carried out, without for all that departing from the scope defined by the extent of the set of claims.

The waste stripping unit 14 may or may not have a waste stripping cassette 22. The two tools 17 and 18 may or may not have a mandrel 34 and sleeve 36.

The invention claimed is:

1. A waste stripping unit for stripping at least one waste zone cut from a blank of a plate element defined according to a layout for the blank, comprising:

two rotating tools arranged and oriented parallel to each other and defining a space from an inlet of the waste stripping unit to an outlet of the waste stripping unit through which the blank may pass as the two rotating tools are rotating, a first one of the two rotating tools comprising at least one stripping needle protruding radially outwards from an outer surface of the first one of the two rotating tools, the at least one stripping needle being positioned according to a position of the at least one waste zone of the blank, the two rotating tools cooperating with each other to strip the at least one waste zone originating from the blank passing through the waste stripping unit and between the two rotating tools to generate at least one stripped waste zone; and a device that includes at least one part inserted in the space between the two rotating tools and placed and configured for forming a support for the blank passing through the space and for forming a passage for the at least one stripped waste zone through the at least one part, wherein the at least one part is a plate including at least one opening through the plate to define the passage for the at least one stripped waste zone through the plate, the at least one opening having a shape and a position in accordance with a layout of the blank, and the at least one opening being defined by flat edges that provide support for the blank passing through the space;

wherein the at least one part comprises at least one longitudinal notch, located at the inlet of the unit, opening out in the passage, and sized to allow the passing of the at least one stripping needle; and wherein the at least one part comprises at least one longitudinal slant, located at the outlet of the unit, the slant having a free edge located in the passage, and oriented in the direction of the first one of the other rotating tools.

2. A waste stripping unit according to claim 1, wherein the at least one part extends through at least a part of the space between the two rotating tools and between the inlet of the waste stripping unit and the outlet of the waste stripping unit.

3. A waste stripping unit according to claim 2, wherein the at least one part has an upper plane extending just below an outer surface of a first one of the rotating tools.

4. A waste stripping unit according to claim 1, further comprising a waste stripping cassette, the cassette comprising a frame provided with bearings positioned and configured for carrying the two rotating tools, and capable of being introduced, attached in and removed from the waste stripping unit.

5. A packaging production machine comprising a waste stripping unit according to claim 1 positioned downstream of a cutting unit for cutting a plane support into plate elements, the waste stripping unit comprising a frame and the two rotating tools.

6. A packaging production machine according to claim 5, further comprising a cutting unit, wherein the waste stripping unit is positioned downstream of the cutting unit.

7. A packaging production machine according to claim 5, further comprising, in succession, from an upstream to a downstream direction, a cutting press with a plate, a drive arrangement, a transfer device, a first vacuum transport, the waste stripping unit, and a second vacuum transport.

* * * * *